US005265393A

United States Patent [19]

Bischel et al.

[11] Patent Number: 5,265,393

[45] Date of Patent: Nov. 30, 1993

[54] DECORATIVE ELEMENTS FOR SUBCEILINGS

[75] Inventors: Wesley T. K. Bischel, Elizabethtown; Joan V. Greenslade, Millersville; Chester W. Hallett; Henry G. Stein, both of Lancaster, all of Pa.

[73] Assignee: Armstrong World Industries, Inc., Lancaster, Pa.

[21] Appl. No.: 32,693

[22] Filed: Mar. 17, 1993

Related U.S. Application Data

[63] Continuation of Ser. No. 843,276, Feb. 28, 1992, abandoned.

[51] Int. Cl.[5] ..... E04F 19/02; E04B 9/26

[52] U.S. Cl. ..... 52/461; 52/484; 52/464; 52/DIG. 8

[58] Field of Search ..... 52/DIG. 8, 716, 287, 52/288, 461, 464, 488, 484

[56] References Cited

U.S. PATENT DOCUMENTS

| | | | |
|---|---|---|---|
| 3,287,874 | 11/1966 | Stahlhut | 52/484 |
| 3,367,077 | 2/1968 | Johnston | 52/464 |
| 4,730,428 | 3/1988 | Head et al. | 52/484 |
| 4,742,662 | 5/1988 | Smith | 52/DIG. 8 |
| 4,848,054 | 7/1989 | Blitzer et al. | 52/DIG. 8 |
| 4,986,050 | 1/1991 | Brunetti et al. | 52/488 |
| 5,014,478 | 5/1991 | Spring | 52/464 |

FOREIGN PATENT DOCUMENTS

| | | | |
|---|---|---|---|
| 2142356 | 1/1985 | United Kingdom | 52/484 |

*Primary Examiner*—Carl D. Friedman
*Assistant Examiner*—Christopher Todd Kent

[57] ABSTRACT

Miniature beams for easy installation onto a conventional inverted T-bar subceiling framework are disclosed. The beams comprise a flat portion or web adapted to fit snugly against the T-bar rail, the web having two hooked arms that snap over the edges of the rail and at least one element extending from the web that has a decorative element at the end of its vertical extension.

6 Claims, 5 Drawing Sheets

Fig. 6
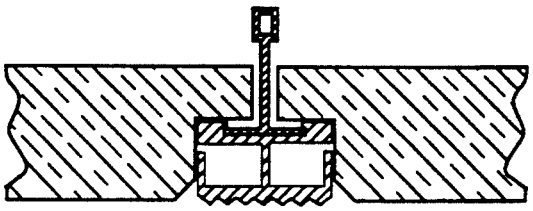
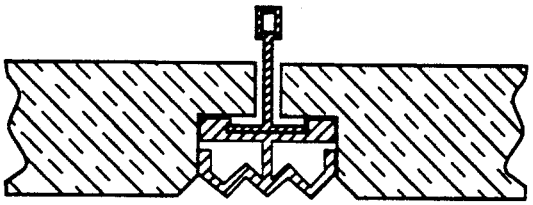
Fig. 7
Fig. 8
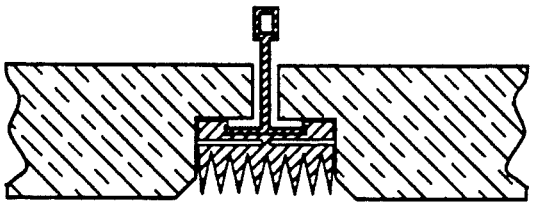
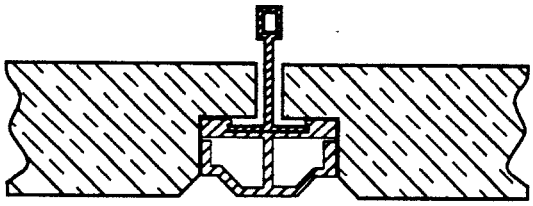
Fig. 9
Fig. 10
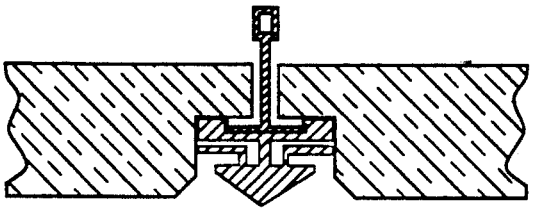
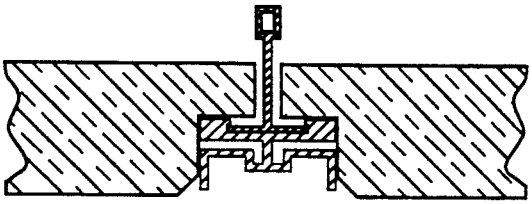
Fig. 11
Fig. 12
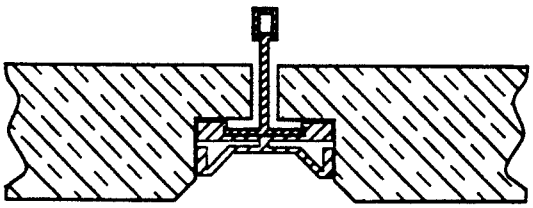
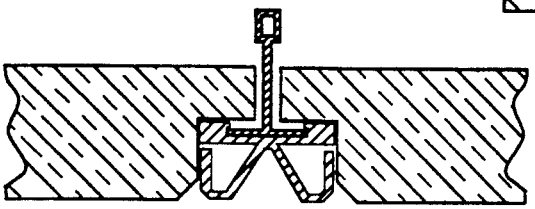
Fig. 13

Fig. 14
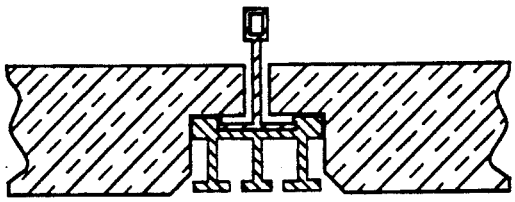
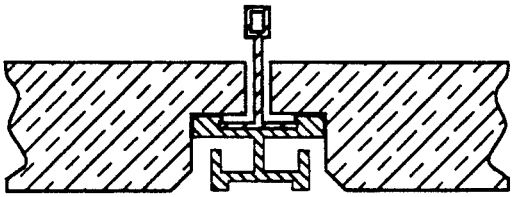
Fig. 15
Fig. 16
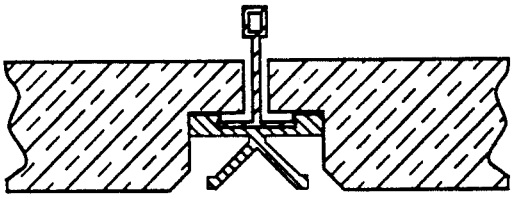
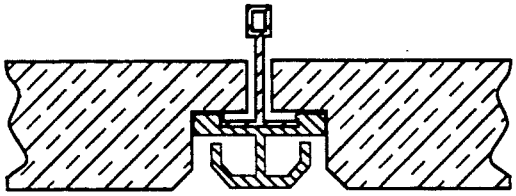
Fig. 17
Fig. 18
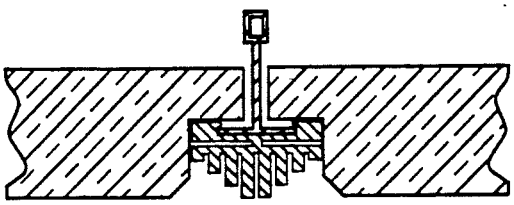
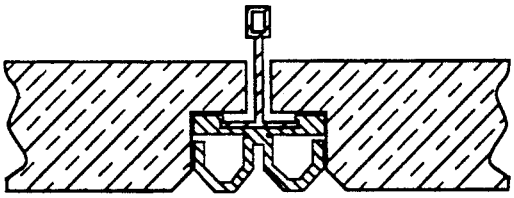
Fig. 19
Fig. 20
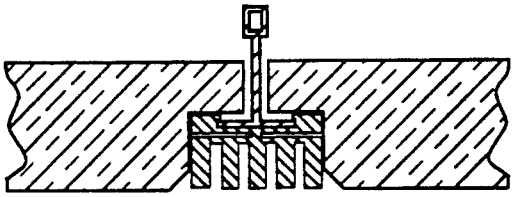
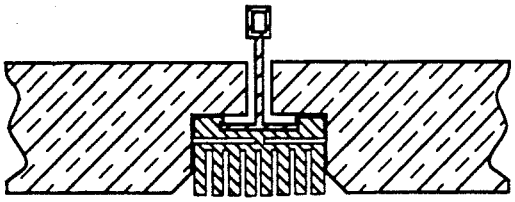
Fig. 21

DECORATIVE ELEMENTS FOR SUBCEILINGS

This application is a continuation of application Ser. No. 843,276, filed Feb. 28, 1992, now abandoned.

This invention relates to subceilings of the type that utilizes square or rectangular panels supported on a suspended framework of interconnected inverted T-bar rails arranged in a series of geometric grid-like patterns, e.g., square, rectangular, etc. More particularly, this invention relates to decorative elements for covering the bottom surfaces of the T-bar rails while the panels rest on and are supported on the top surfaces of the T-bar rails.

BACKGROUND

1. Field of the Invention

Subceilings formed from square or rectangular panels resting on the top surfaces of horizontally disposed flanges of inverted T-bar rails are well known. Typically, a framework of rails is formed with parallel main runners, suspended from the ceiling above, intersecting with cross rails to provide a grid pattern, usually as 2 feet×2 feet squares or 2 feet×4 feet rectangles, to accommodate similarly-sized subceiling panels. In its basic functional form, the subceilings would have the bottom surfaces of the rail flanges exposed as flat boundary strips between the edge supported panels.

For what has become the conventionally styled and dimensionally standardized version of the inverted T-bar rail, the industry has developed tight-fitting capping elements. By cutting and removing a portion of the panel along its length- and width-extending bottom edges to accommodate the thickness of the capped T-bar rails, a substantially smooth flat bottom surface of the subceiling may be defined.

It has ben an objective to provide the option of various architecturally-satisfying decorative effects in suspending ceilings that have exposed flat T-bar flanges in addition to the mere capping discussed in the previous paragraph. It has also been an objective to provide such decorative effects with elements that are designed to be easily added in place or easily removed and replaced to satisfy the customer's "addiction" to his or her "remodeling habit".

2. The Prior Art

In U.S. Pat. No. 4,848,054, the patentee has provided a hollow beam that is readily attachable to the conventional T-bar support from below without requiring additional fastening hardware such as clips or screws. He alleges that his hollow beams are not only useful in new ceiling installations but have the potential for convenient future renovation by changing to hollow beams of different size, shape, color or texture without disturbing the support framework.

It is a similar object of the present invention to provide beams for capping the inverted T-bar support rails used in conventional support systems for subceilings that are readily attachable and removable from below without using any additional fastening hardware.

It is a further object of the present invention to provide a beam that is, once in place, constrained from undesired movement such as skewing or riding upwardly on the rail flanges.

It is a still further object to provide an element that is simpler and less expensive than the hollow beams of the prior art and displays a substantially greater amount of versatility than the hollow beams or the capping elements of the prior art.

SUMMARY OF THE INVENTION

The objects of this invention are accomplished by a decorative capping beam for covering the inverted tee-bar (T-bar) panel support rail comprising:

- a flat portion;
- flange disposed along one upper edge of the flat portion integral therewith and extending inwardly;
- a second return flange disposed along a second upper edge of the flat portion integral therewith and extending inwardly;
- each of said return flanges having a downward-facing surface and an inwardly facing edge;
- at least one, but preferably one, vertically extending structural element from the bottom surface of the flat portion and integral at its upper surface with the bottom surface of the flat portion;
- a decorative element attached to, or integral with, the bottom surface of the vertically extending structural element, the decorative element preferably extending horizontally.

In simple terms, the invention is the combination of a tee shaped ceiling support grid to which dimensional decorative elements are applied. The elements snap on the face of the grid via resilient hooked arms. The arms are connected by a web which lies against the face of the tee shaped grid when engaged. Perpendicular to this face is preferably a single vertical member which connects the decorative portion of the element to the web. The snap-on feature, therefore, is not necessarily integral with the decorative feature. Thus, the decorative feature is not restricted in size or shape by the attachment mechanism or by the tee grid. In addition, the dimensional element can be snapped onto the grid with ease. Pressure exerted on the face of the element is transferred through the vertical member. The force is then equally transferred to both resilient hooked arms. By having the arms free from the vertical member, they are able to flex freely around the grid face and engage simultaneously. No "rocking" of the element against the face of the grid is necessary to attach the profile to the grid. The dimensional element may be either factory or field applied. Having a universal shape for the attachment portion, regardless of the decorative face, lends itself to automated assembly. No matter what the design of the profile may be, the consistency of the attachment portion provides a place to capture the part for robotic assembly.

The dimensional element may be extruded, molded, or machined from plastic, wood, metal, composite materials or any material with sufficient flexibility as a thin member to allow the element to snap over the tee grid. Preferred is a material with low thermal expansion (Coefficient of Thermal Expansion of less than or equal to $3.0\times10^{-5}$ in/in° F.) similar to the grid. In this way, the dimensional element does not move, warp, or gap with changes in ambient temperature once it is applied to the grid.

This invention will bring a new ease to designing and manufacturing grid. Metal roll forming, which is typically used to produce grid, would have required a new roll forming mill for each design desired on the grid face. A new mill is a costly investment. To change from one design product to another would be quite expensive and time consuming. With the present invention, new roll formers are no longer required since no change is made to the grid. To change the appearance of the grid using the present invention, one simply applies a different dimensional element to the tee grid. The saving of time, money and effort is substantial.

Furthermore, by using a method other than roll forming permits the formation of complex designs for the decorative element. This flexibility, in turn, lends itself to creating visually integrated ceiling systems. The ceiling board could be cut to complement the decorated grid visually.

Also, the elements of this invention could be designed to be compatible with tegularized ceiling board edge details as well as with flush panels. For larger dimensional elements extending beyond the face of the tee grid, the ceiling board could be specially cut along its edge so that the board may rest on the tee shaped ceiling support grid. This synergy of the ceiling and grid greatly enhances the overall appearance of an accessible ceiling. Alternatively, the board could be cut to rest on the dimensional element directly.

A critical element of a ceiling suspension system is the intersection of members that are perpendicular to one another, e.g., where four ceiling boards meet. To accommodate any profile that the dimensional element might have, the present invention may utilize a double miter at the end of each profile in the intersection. This feature is profile independent, thus providing a universal intersection. In addition, the appearance is tailored and identical at each intersection in the ceiling. No further notching of the dimensional element is required, either at the factory or on the job site, to allow clearance for the intersection of the support grid. The underlying tee shaped grid may still intersect in a flush manner as is typical for this type of suspension system, but this unattractive intersection would not be visible from the room below since the mitered dimensional elements would cover it.

The advantages of the present invention may be summarized, as follows:

1. It uses less material than the hollow beam of U.S. Pat. No. 4,722,161;

2. Since the attachment mechanism may not be integral with the vertical member, it is easier to snap the element onto the tee grid (no "rocking" is required to engage);

3. The decorative face does not have to be the same size as the tee grid face;

4. The flexibility of design allows coordination between the design of the ceiling board with the design of the dimensional element resulting in a distinct improvement in accessible ceiling appearance;

5. By using thermally stable material to make the element permits its application in the factory, as well as on site, without the dimensional elements "drifting" on the tee grid due to exposure to changes in temperature during shipping or at the installation site;

6. The double ion will require no notching of the invented element to accommodate the underlying tee grid intersection; in addition, the double miter will provide an improved, tailored appearance.

BRIEF DESCRIPTION OF THE DRAWINGS

The invention will be more clearly understood by referring to the drawings and the detailed description that follows.

In the drawings:

FIGS. 6–22 are cross-sectional views of beams having a variety of specially designed decorative elements.

DETAILED DESCRIPTION

Figure 1:
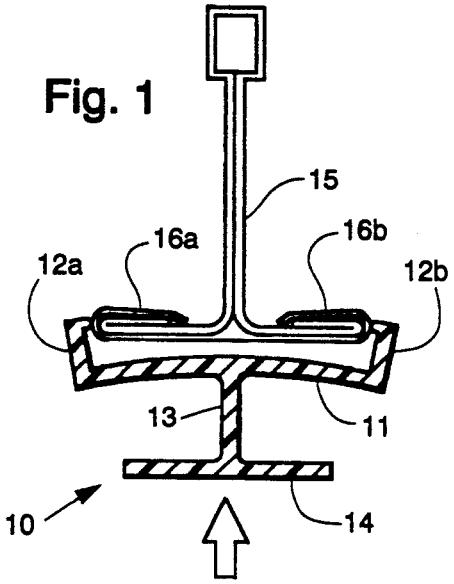
FIG. 1 is a cross-sectional view of a beam of this invention in an initial position in the process of being installed onto a conventional inverted T-bar rail.

FIG. 1 is a cross-sectional view showing the configuration of a beam 10 constructed in accordance with the present invention. Beam 10 is basically composed of three associated elements: the decorative element 14, integrated through (or attached to) a vertically disposed connecting element 13 which may be integral with, or attached to, the substantially resilient fastening element. The fastening element is composed of a substantially horizontal flat or face portion 11 adapted to contact the outer surface of the T-bar and having hooked arms or return flanges **12*a* and 12*b* along each upper edge integral with the face portion 11** and extending inwardly.

Beam 10 may be fabricated from metal, wood, etc., but preferably it is fabricated from a flexible tough plastic such as polypropylene, high density polyethylene, an acrylic copolymer or homopolymer, etc.

In FIG. 1, beam 10 is shown with the hooked arms or return flanges **12*a* and 12*b* flexed outwardly as the beam is being forced over the rolled flanged edges 16*a* and 16*b* of the "T-bar rail" 15. The inverted T-bar rails comprise the framework suspended in a grid pattern to support the square or rectangular panels that form the ceiling. They represent the type of inverted T-bar rails 15 that are currently used for both residential and commercial ceilings. The support wires, that serve to suspend the rails by being looped through an opening in the rails and then connected to the building structure above, are not shown. A relatively mild force applied by hand, as indicated by the arrow, holds return flanges 12*a* and 12*b* upwardly against the sides of the edges of flanges 16*a* and 16*b***, respectively.

Figure 2:
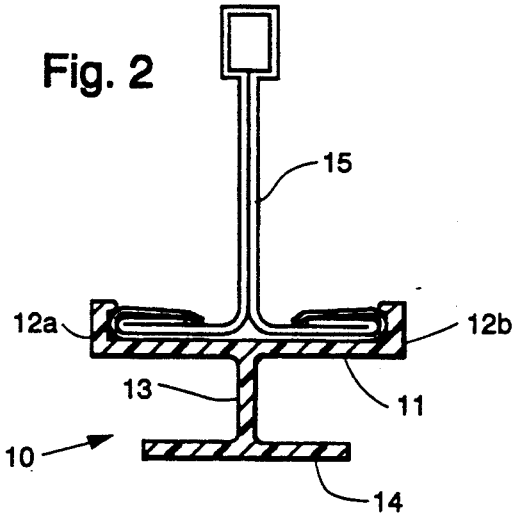
FIG. 2 is a cross-sectional view of the beam shown in FIG. 1 after installation on the T-bar rail.

FIG. 2 shows the beam 10 in its installed position. By continuing to apply the mild pressure, the return flanges or arms **12*a* and 12*b* ultimately snap over and rest on the flanges 16*a* and 16*b* and the flat portion 11 fits snugly against the outer surface of the "T" of the T-bar rail 15. Flat portion 11 acts as a strike plate to constrain any skewing or other movement of the beam 10**.

Figure 3:
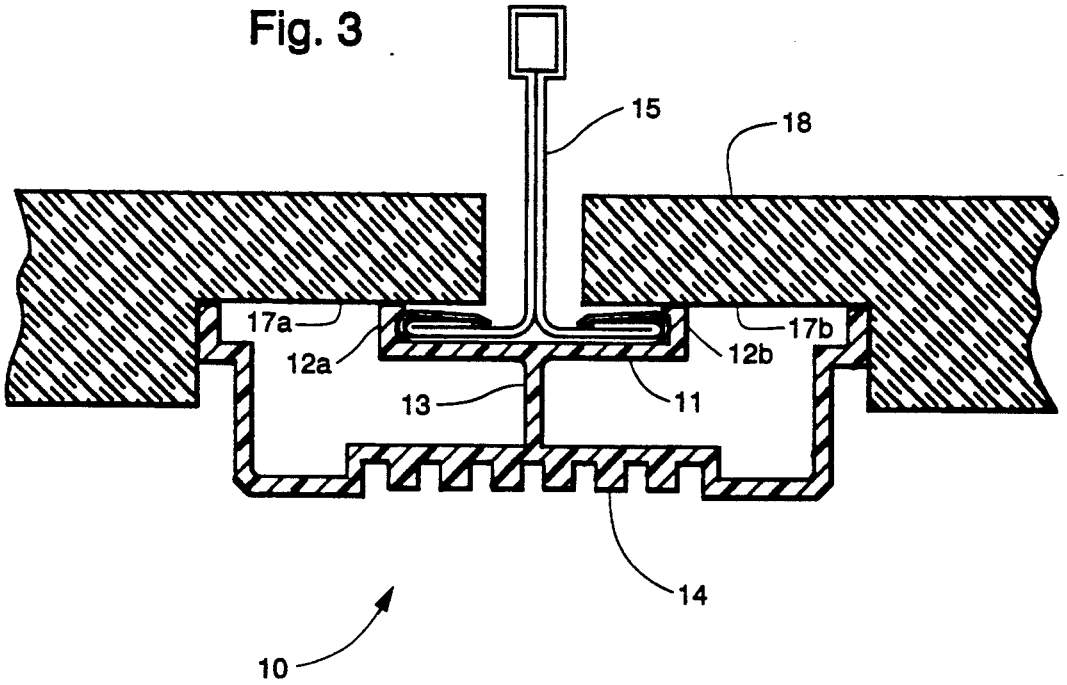
FIG. 3 is a cross-sectional view of a beam installed on a T-bar rail, along with subceiling panels in place, the beam having a specially designed decorative element integral therewith.

In FIG. 3, the end portions of ceiling panels **17*a* and 17*b* are shown in place resting on return flanges 12*a* and 12*b* with the decorative element 14 of beam 10 serving to provide a covering for the usually metal surface of the T-bar rail 15. The final result is a smooth, visually effective ceiling. Various design elements associated with the other two basic elements are shown in FIGS. 6 through 22. It will be noted that the connecting element 13 may extend from the flat portion 11** of the fastening element to a level where the decorative element is below, above, or at the same level as the exposed surface of the ceiling panel.

Figure 4:
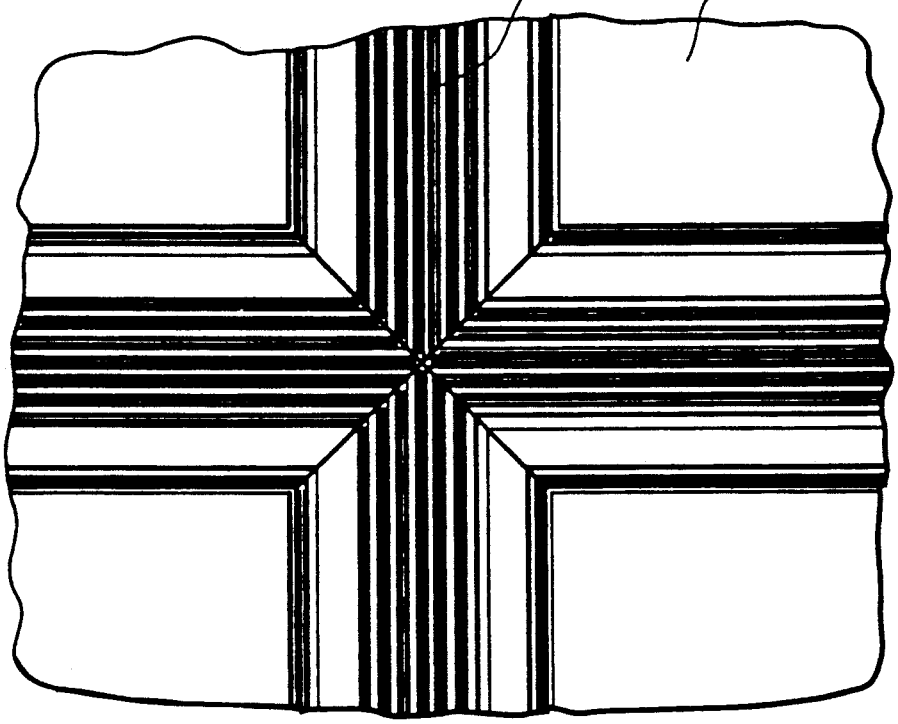
FIG. 4 is a bottom view of the subceiling at the mitered intersection of four beams, each of which is shown in cross-section in FIG. 3.
Figure 5:
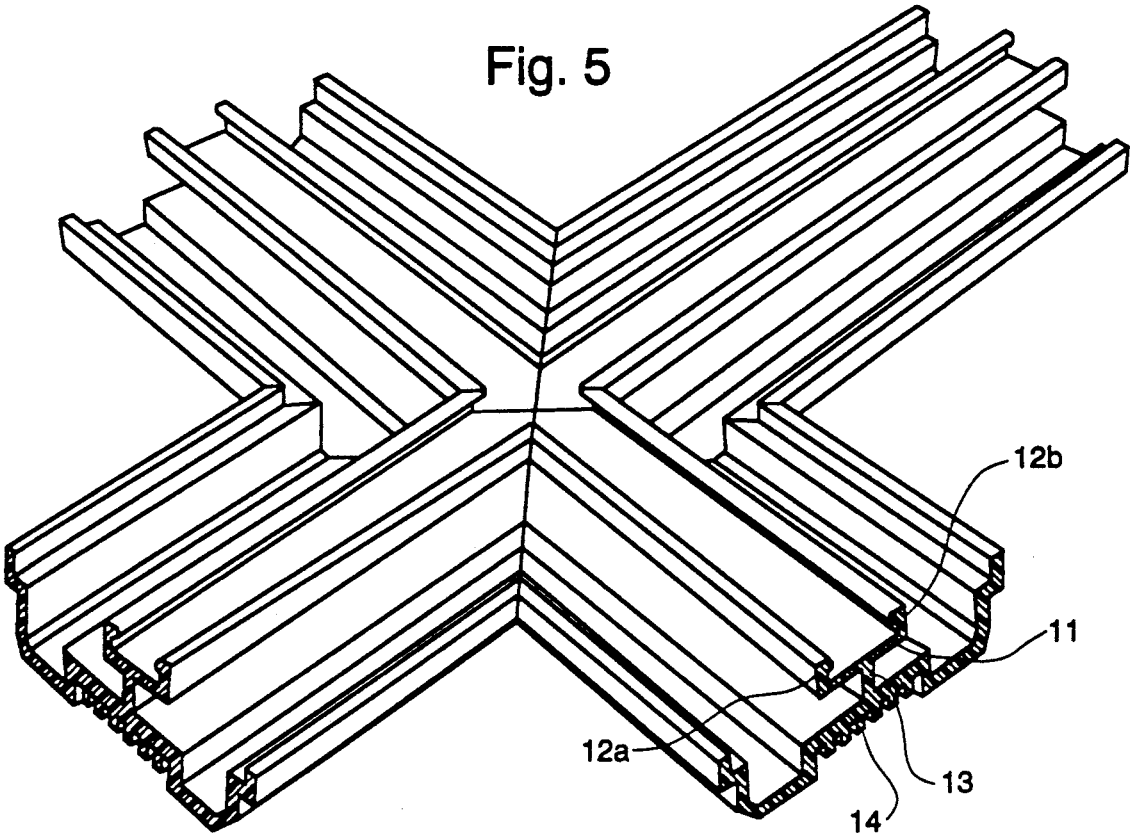
FIG. 5 is a top view, in perspective, of the mitered intersection of two runner beams and two cross beams of FIGS. 3 and 4.
Figure 22:
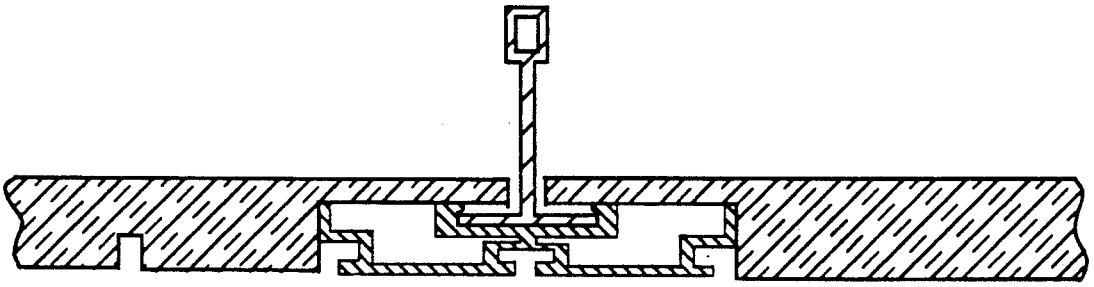

FIG. 4 is a bottom view of the subceiling composed of ceiling panels 18 and mitered beams having the decorative elements 14 shown in FIG. 3. FIG. 5 is a top view of the four intersecting mitered beams shown in FIG. 4. It will be noted that although they are not shown, the inverted T-bar rails used as runners and cross members may be the standard "unmitered" rails currently employed for the suspended framework that constitutes the grid.

What is claimed is:

1. In combination, a subceiling of the type having panels supported by a suspended framework consisting essentially of (1) longitudinally extending main runner members and cross runner members, each runner member being configured as an inverted T-bar rail having a transverse pair of opposed bottom flanges extending longitudinally, (2) a plurality of miniature beams having means for fastening to the T-bar rails, each of said beams consisting essentially of:

a flat portion having an upper surface and a bottom surface, and a width defined by two longitudinal edges;

a first return flange disposed along one upper edge of the flat portion integral therewith and extending inwardly;

a second return flange disposed along a second upper edge of the flat portion integral therewith and extending inwardly;

each of said return flanges having a downward-facing surface and an inwardly facing edge;

said return flanges adapted to hold the upper surface of said flat portion substantially flush against the longitudinally extending T-bar rails of the runner member;

a single connecting element integral with and extending downwardly from said bottom surface of said flat portion and longitudinally along the length of said bottom surface of said flat portion;

and a longitudinally extending decorative element attached to or integral with the downward extremity of said connecting element and comprising a pair of transversely extending elements;

and (3) a plurality of panels extending longitudinally with said runner members, said panels adapted to rest on the return flanges of the beams.

2. In combination, a subceiling of the type having panels supported by a suspended framework consisting essentially of (1) longitudinally extending main runner members and cross runner members, each runner member being configured as an inverted T-bar rail having a transverse pair of opposed bottom flanges extending longitudinally, (2) a plurality of miniature beams having means for fastening to the T-bar rails, each of said beams consisting essentially of:

a flat portion having an upper surface and a bottom surface, and a width defined by two longitudinal edges;

a first return flange disposed along one upper edge of the flat portion integral therewith and extending inwardly;

a second return flange disposed along a second upper edge of the flat portion integral therewith and extending inwardly;

each of said return flanges having a downward-facing surface and an inwardly facing edge;

said return flanges adapted to hold the upper surface of said flat portion substantially flush against the longitudinally extending T-bar ails of the runner member;

a single connecting element integral with and extending downwardly from said bottom surface of said flat portion and longitudinally along the length of said bottom surface of said flat portion;

and a longitudinally extending decorative element attached to or integral with the downward extremity of said connecting element and comprising a pair of transversely extending elements; and (3) a plurality of panels extending longitudinally with said runner members, the bottom surface of said panels being recessed along the edges of the panels to provide longitudinally extending recessed portions, said recessed portions adapted to rest on the return flanges of the beams.

3. A subceiling as in claim 2 wherein the decorative element is in the same horizontal plane as that of the panels supported on the suspended framework.

4. A subceiling as in claim 2 wherein each of the decorative elements of four miniature beams at the intersection of main runner members and cross runner members are double-mitered to provide a smooth appearing intersection.

5. A suspended framework consisting essentially of (1) longitudinally extending main runner members and cross runner members, each runner member being configured as a inverted T-bar rail having a transverse pair of opposed bottom flanges extending longitudinally, (2) a plurality of miniature beams having means for fastening to the T-bar rails, each of said beams consisting essentially of:

a flat portion having an upper surface and a bottom surface, and a width being defined by two longitudinal edges;

a first return flange disposed along one upper edge of the flat portion integral therewith and extending inwardly;

a second return flange disposed along a second upper edge of the flat portion integral therewith and extending inwardly;

each of said return flanges having a downward-facing surface and an inwardly facing edge;

said return flanges adapted to hold the upper surface of said flat portion substantially flush against the longitudinally extending T-bar rails of the runner member;

a single connecting element integral with and extending centrally and downwardly from said bottom surface of said flat portion and longitudinally along the length of said bottom surface of said flat portion;

and a longitudinally extending decorative element attached to or integral with the downward extremity of said connecting element and comprising a pair of transversely extending elements.

6. A suspended framework as in claim 5 wherein said longitudinally extending decorative element is integral with the downward extremity of said connecting element.

* * * * *